US005155003A

United States Patent [19]

Chang

[11] Patent Number: 5,155,003

[45] Date of Patent: Oct. 13, 1992

[54] THERMAL IMAGING MEDIUM

[75] Inventor: Kuang C. Chang, Lexington, Mass.

[73] Assignee: Polaroid Corporation, Cambridge, Mass.

[21] Appl. No.: 616,982

[22] Filed: Nov. 21, 1990

[51] Int. Cl.[5] ..... G03C 3/00

[52] U.S. Cl. ..... 430/200; 430/253; 430/258; 430/259; 430/261; 430/262; 430/273; 430/945; 503/227

[58] Field of Search ..... 430/200, 261, 262, 259, 430/256, 253, 273, 945; 503/227

[56] References Cited

U.S. PATENT DOCUMENTS

| | | | |
|---|---|---|---|
| 2,616,961 | 9/1952 | Groak | 178/5.2 |
| 3,257,942 | 6/1966 | Fitzerfeld et al. | 101/149.4 |
| 3,340,086 | 9/1967 | Groak | 117/36.4 |
| 3,396,401 | 8/1968 | Nonomura | 346/1 |
| 3,592,644 | 7/1971 | Vrancken et al. | 96/27 |
| 3,632,376 | 1/1972 | Newman | 117/35.5 |
| 3,924,041 | 12/1975 | Miyayama | 428/212 |
| 4,123,578 | 10/1978 | Perrington | 428/206 |
| 4,157,412 | 6/1979 | Deneau | 428/147 |
| 4,245,003 | 1/1981 | Oransky et al. | 430/200 |
| 4,284,703 | 8/1981 | Inoue et al. | 430/253 |
| 4,388,362 | 6/1983 | Iwata et al. | 430/200 |
| 4,626,493 | 12/1986 | Butlers et al. | 430/273 |

FOREIGN PATENT DOCUMENTS

| | | |
|---|---|---|
| 8804237 | 6/1988 | PCT Int'l Appl. . |
| 1156996 | 7/1969 | United Kingdom . |

OTHER PUBLICATIONS

Patent Abstracts of Japan, vol. 12, No. 164 (M-698) (3011 18 May 1988.

Patent Abstracts of Japan, vol. 10, No. 142 (M-481) (2199) 24 May 1986.

*Primary Examiner*—Marion E. McCamish
*Assistant Examiner*—Mark A. Chapman
*Attorney, Agent, or Firm*—Louis G. Xiarhos

[57] ABSTRACT

There is disclosed a thermal imaging laminar medium, actuatable in response to intense image-forming radiation for production of an image, and including a thermoplastic intermediate layer which, upon separation of the sheet-like or web materials of the laminar medium after thermal exposure, provides surface protection for one of the pair of images obtained thereby.

18 Claims, 1 Drawing Sheet

THERMAL IMAGING MEDIUM

BACKGROUND OF THE INVENTION

This invention relates to a thermal imaging medium for the recordation of information. More particularly, it relates to an imaging medium especially adapted to the provision of thermally actuated images having improved handling, durability and abrasion-resistance characteristics.

The provision of images from media which rely upon the generation of heat patterns has been well known. Thermally imageable media are particularly advantageous inasmuch as they can be imaged without certain of the requirements attending the use of silver halide based media, such as darkroom processing and protection against ambient light. Moreover, the use of thermal imaging materials avoids the requirements of handling and disposing of silver-containing and other processing streams or effluent materials typically associated with the processing of silver halide based imaging materials.

Various methods and systems for preparing thermally generated symbols, patterns or other images have been reported. Examples of these can be found in U.S. Pat. No. 2,616,961 (issued Nov. 4, 1952 to J. Groak); in U.S. Pat. No. 3,257,942 (issued Jun. 28, 1966 to W. Ritzerfeld, et al.) in U.S. Pat. No. 3,396,401 (issued Aug. 6, 1968 to K. K. Nonomura); in U.S. Pat. No. 3,592,644 (issued Jul. 13, 1971 to M. N. Vrancken, et al.); in U.S. Pat. No. 3,632,376 (issued Jan. 4, 1972 to D. A. Newman); in U.S. Pat. No. 3,924,041 (issued Dec. 2, 1975 to M. Miyayama, et al.); in U.S. Pat. No. 4,123,578 (issued Oct. 31, 1978 to K. J. Perrington, et al.); in U.S. Pat. No. 4,157,412 (issued Jun. 5, 1979 to K. S. Deneau); in Great Britain Patent Specification 1,156,996 (published Jul. 2, 1969 by Pitney-Bowes, Inc.); and in International Patent Application No. PCT/US87/03249 of M. R. Etzel (published Jun. 16, 1988, as International Publication Number WO 88/04237).

In the aforementioned International Application, there is disclosed a thermal imaging medium which includes a layer of porous or particulate image-forming material and which is especially adapted to the provision of high resolution images by subjecting the medium to brief exposure to intense image-forming radiation. According to a preferred embodiment, the image-forming material (preferably, a layer of carbon black) is coated over the heat-activatable image-forming surface of a first sheet-like or web material and is covered with a second laminated sheet-like element, such that, the image-forming substance is confined between the sheet-like elements of a thermal imaging laminar medium. Upon exposure of the medium (for example, by laser scanning) and on separation of the sheet-like elements, a pair of images is obtained.

A first image comprises exposed portions of image-forming substance more firmly attached to the first sheet element by heat activation of the heat-activatable image-forming surface. A second image comprises non-exposed portions of the image-forming substance carried or transferred to the second sheet element.

The respective images obtained by separating the sheets of an exposed thermal imaging medium having an image-forming substance confined therebetween may exhibit substantially different characteristics. Apart from the imagewise complementary nature of these images and the relation that each may bear as a "positive" or "negative" of an original, the respective images may differ in character. Differences may depend upon the properties of the image-forming substance, on the presence of additional layer(s) in the medium, and upon the manner in which such layers fail adhesively or cohesively upon separation of the sheets. Either of the pair of images may, for reasons of informational content, aesthetics or otherwise, be desirably considered the principal image. The principal image may, however, depending upon the aforementioned properties and modes of failure, exhibit decidedly inferior properties, such as poorer handling characteristics, durability and abrasion resistance, as compared with the complementary image of secondary importance.

In the production of thermal images from media of the type described in the aforementioned International Application, it will oftentimes be preferred, in the case of high density images, that the principal image be that which is formed by transfer of non-exposed regions of coated image-forming substance to a sheet separated from an imaged medium. It will be recognized that an alternative is to form a high density image on the opposed sheet by firmly attaching the image-forming substance in areas of exposure. This is the case because the medium provides complementary images and the desired high density image can be formed on either sheet by addressing the thermally actuatable medium according to which sheet shall bear the high density image. This alternative to the formation of a high density image is, however, disadvantageous since the areas of high density are created in areas of exposure (by activation of a heat-activatable image-forming zone or layer) and large areas of exposure require correspondingly large areas of laser actuation and energy utilization and highly accurate laser scanning and tracking. Errors in tracking will result in discontinuities (whiteness or voids) by failure to attach minute regions of image-forming substance and by their removal to the opposed sheet upon separation of the sheets. Owing to the psychophysical nature of human vision, minute regions of lightness (voids) against an expansive darkness tend to be noticeable.

It will, thus, be preferred that a high density image be the result of the transfer in non-exposed regions of coated and continuous regions of image-forming material (with minimal or no discontinuities or coverage voids), rather than the result of firm connection of high density regions of imaging material by laser-actuated operation of the heat-activatable image-forming surface, where tracking errors increase the possibility of creating noticeable areas of discontinuity (whiteness) against the expansive high density region. Images comprising image-forming material transferred in non-exposed regions tend, however, to exhibit less durability and resistance to scratching than the complementary image. Inasmuch as such images may be preferred for the value of their informational content, and are especially desired for medical diagnostic purposes, there is an interest in providing a thermal imaging medium capable of providing such images with improved handling, durability and abrasion-resistance characteristics.

SUMMARY OF THE INVENTION

It has been found that improvements in the handling, durability and abrasion resistance of an image formed in porous or particulate image-forming substance by non-exposed regions of said substance carried to a sheet-like web material on separation of a pair of sheets of a thermally actuated imaging medium, can be obtained by including, in the thermally actuatable imaging medium, a thermoplastic intermediate layer which, on separation of the respective sheets after thermal imaging, adheres preferentially to the surface of said image formed by said non-exposed porous or particulate image-forming substance, and which intermediate layer provides surface protection for said image and improved handling, durability and abrasion-resistance characteristics.

According to an article aspect of the present invention, there is provided a thermal imaging laminar medium, actuatable in response to intense image-forming radiation for production of images in porous or particulate image-forming substance. The thermal imaging laminar medium comprises, in order:

a first sheet-like web material, said web material being transparent to said image-forming radiation and having at least a surface zone or layer of polymeric material heat-activatable upon subjection of said thermal imaging medium to brief and intense radiation;

a thermoplastic intermediate layer having cohesivity in excess of its adhesivity for said surface zone or layer of heat-activatable polymeric material;

a layer of porous or particulate image-forming substance on said thermoplastic intermediate layer, said porous or particulate image-forming substance having adhesivity for said thermoplastic intermediate layer in excess of the adhesivity of said thermoplastic intermediate layer for said surface zone or layer of heat-activatable polymeric material; and a second sheet-like web material covering said layer of porous or particulate image-forming substance and laminated directly or indirectly to said image-forming substance;

said thermal imaging medium being capable of absorbing radiation at or near the interface of said surface zone or layer of heat-activatable polymeric material and said thermoplastic intermediate layer, at the wavelength of the exposing source, and being capable of converting absorbed energy into thermal energy of sufficient intensity to heat activate said surface zone or layer rapidly; said heat-activated surface zone or layer, upon rapid cooling, attaching said thermoplastic intermediate layer firmly to said first sheet-like web material;

said thermal imaging medium being adapted to image formation by exposure of portions of said thermal imaging medium to radiation of sufficient intensity to attach exposed portions of said thermoplastic intermediate layer and image-forming substance firmly to said first sheet-like web material, and by removal to said second sheet-like web material, upon separation of said first and second sheet-like web materials after said exposure, of unexposed portions of said image-forming substance and said thermoplastic intermediate layer, thereby to provide first and second images, respectively, on said first and second sheet-like web materials;

said thermoplastic intermediate layer providing surface protection for said second image on said second sheet-like web material.

For a fuller understanding of the nature and objects of the invention, reference should be had to the following detailed description taken in conjunction with the accompanying drawings.

DETAILED DESCRIPTION OF THE INVENTION

As mentioned previously, the thermal laminar medium of the invention embodies an intermediate layer which, upon separation of the sheets thereof after imaging, provides improved durability and handling properties to one of the images.

Figure 1:
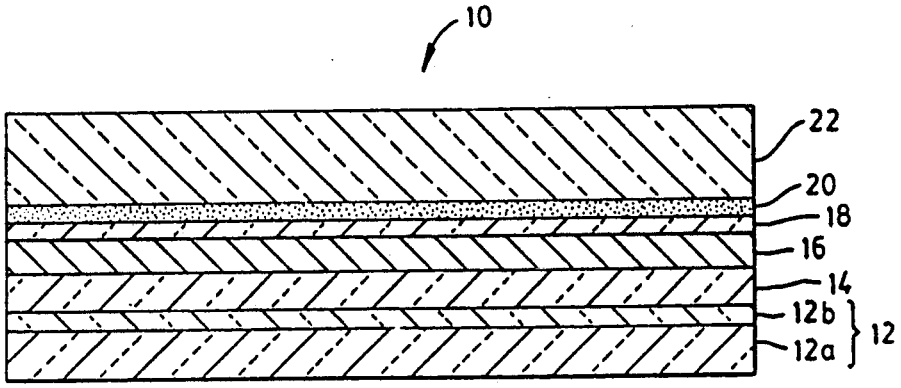
FIG. 1 is a diagrammatic cross-sectional view of a thermal imaging laminar medium of the invention.
Figure 2:
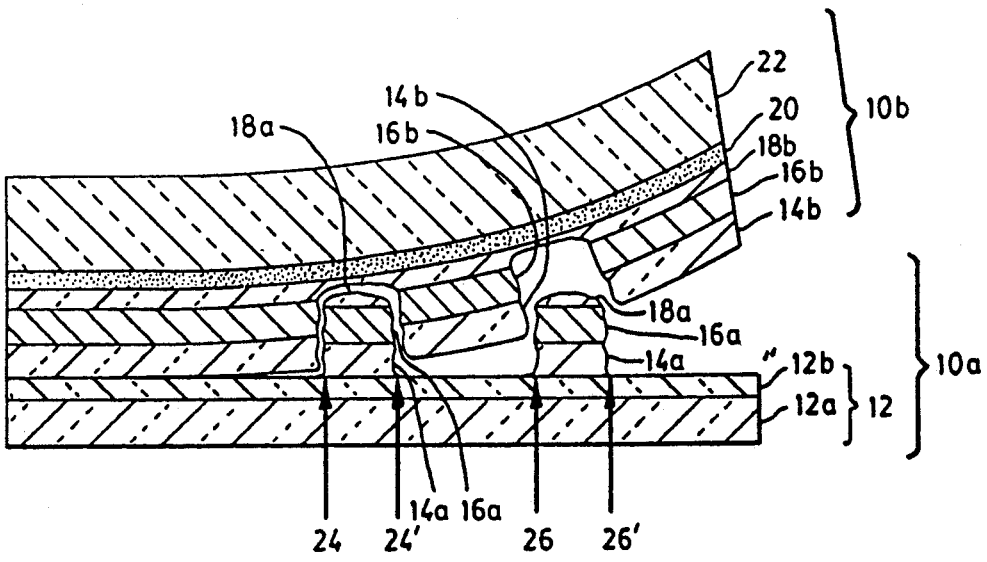
FIG. 2 is a diagrammatic cross-sectional view of the thermal imaging laminar medium of FIG. 1, shown in a state of partial separation after thermal imaging.

Referring to FIG. 1, there is shown a preferred thermal imaging laminar medium 10 suited to use in the production of a pair of images, shown as images 10*a* and 10*b* in a partial state of separation in FIG. 2. Thermal imaging medium 10 includes a first sheet-like web material 12 having superposed thereon, and in order, thermoplastic intermediate layer 14, porous or particulate image-forming layer 16, release layer 18, adhesive layer 20 and second sheet-like web material 22. Upon exposure of the thermal imaging medium to radiation, exposed portions of intermediate layer 14 and image-forming layer 16 are attached firmly to sheet-like web material 12, so that, upon separation of the respective sheet-like web materials, as shown in FIG. 2, a pair of images, 10*a* and 10*b*, is provided. The nature of the layers of thermal imaging medium 10 and their properties are importantly related to the manner in which the respective images are partitioned from the thermal imaging medium after exposure and materially influence the manner in which intermediate layer 14 provides image-protecting functionality for image 10*b*. The various layers of imaging medium 10 are described in detail hereinafter.

Sheet-like web material 12 comprises a transparent material through which imaging medium 10 can be exposed to radiation. Web material 12 can comprise any of a variety of sheet-like materials, although polymeric sheet materials will be especially preferred. Among preferred web materials are polystyrene, polyethylene terephthalate, polyethylene, polypropylene, poly(vinyl chloride), polycarbonate, poly(vinylidene chloride), cellulose acetate, cellulose acetate butyrate and copolymeric materials such as the copolymers of styrene, butadiene and acrylonitrile, including poly(styrene-co-acrylonitrile). An especially preferred web material from the standpoints of durability, dimensional stability and handling characteristics is polyethylene terephthalate, commercially available, for example, under the tradename Mylar, of E. I. duPont de Nemours & Co., or under the tradename Kodel, of Eastman Kodak Company.

The surface of web material 12 is important to the thermal imaging of medium 10. At least a surface zone or layer of web material 12 comprises a polymeric material which is heat activatable upon subjection of medium 10 to brief and intense radiation, so that, upon rapid cooling, exposed portions of the surface zone or layer are firmly attached to intermediate layer 14. According to a preferred embodiment, web material 12 comprises a portion 12*a*, of a web material such as polyethylene terephthalate, having a surface layer 12*b* of a polymeric material that can be heat activated at a temperature lower than the softening temperature of portion 12*a*. A suitable material for surface layer 12*b* comprises a polymeric material which tends readily to soften so that exposed portions of layer 12*b* and layer 14 can be firmly attached to web 12. A variety of polymeric materials can be used for this purpose, including polystyrene, poly(styrene-co-acrylonitrile), poly(vinyl butyrate), poly(methylmethacrylate), polyethylene and poly(vinyl chloride).

The employment of a thin surface layer 12b on a substantially thicker and durable web material 12a permits desired handling of web material 12 and desired imaging efficiency. It will be appreciated, however, that web 12 can comprise a unitary sheet material (not shown) provided that, upon exposure of the medium to radiation and absorption of light and conversion to heat, the web material and particularly the surface portion or zone thereof adjacent layer 14 can be made to firmly attach to the material of layer 14.

In general, the thickness of web material 12 will depend upon the desired handling characteristics of medium 10 during manufacture, during imaging and any post-imaging steps and on the desired and intended use of the image to be carried thereon. Typically, web material 12 will vary in thickness from about 0.5 mil to seven mils (0.013 mm to 0.178 mm). Thickness may also be influenced by exposure conditions, such as the power of the exposing source of radiation. Good results can be obtained using a polymeric sheet 12 having a thickness of about 0.75 mil (0.019 mm) to about two mils (0.051 mm) although other thicknesses can be employed.

Where surface zone 12b of web material 12 comprises a discrete layer of polymeric material, layer 12b will be very thin and typically in the range of about 0.1 to five microns. The use of a thin layer 12b facilitates the concentration of heat energy at or near the interface between layers 12b and 14 and permits optimal imaging effects and reduced energy requirements. It will be appreciated that the sensitivity of layer 12b to heat activation (or softening) and attachment or adhesion to layer 14 will depend upon the nature and thermal characteristics of layer 12b and upon the thickness thereof. Good results are obtained using, for example, a web material 12 having a thickness of about 1.5 to 1.75 mils (0.038 to 0.044 mm) carrying a surface layer 12b of poly(styrene-co-acrylonitrile) having a thickness of about 0.1 to five microns. Other web materials can, however, be employed.

A discrete layer 12b of heat-activatable material can be provided on a web material 12a by resort to known coating methods. For example, a layer of poly(styrene-co-acrylonitrile) can be applied to a web 12a of polyethylene terephthalate by coating from an organic solvent such as methylene chloride. If desired, web material 12a can contain additional subcoats (not shown) such as are known in the art to facilitate adhesion of coated materials. If desired, an additional compressible layer (not shown) having stress-absorbing properties can be included in medium 10 as an optional layer between web material 12a and surface layer 12b. Such optional and compressible layer serves to absorb physical stresses in medium 10 and to prevent undesired delamination at the interface of layer 12b and layer 14. Inclusion of a compressible layer facilitates the handling and slitting of medium 10 and permits the conduct of such manipulatory manufacturing operations as may otherwise result in stress-induced delamination. A thermal imaging medium incorporating a stress-absorbing layer is described and claimed in the commonly-assigned patent application of Neal F. Kelly, for Stress-Absorbing Thermal Imaging Laminar Medium, U.S. Ser. No. 07/616,854, filed of even date.

Layer 14, as shown in FIG. 1, comprises a thermoplastic material which is superposed upon and contiguous with the surface zone or layer 12b of web material 12. As can be seen from FIG. 1, layer 14 of imaging medium 10, before thermal imaging, comprises an internal or intermediate layer among the several layers shown as component layers of the medium. During imaging and in the separation of a pair of images, as shown in FIG. 2, the material of layer 14 serves important functions which are related to the nature of the layer, and particularly, its physical properties. It will be appreciated from the partitioning of images 10a and 10b, as shown in FIG. 2, that layer 14 has a degree of cohesivity in excess of its adhesivity for surface zone or layer 12b. In addition, the cohesivity of layer 14 is in excess of the adhesivity of the layer to porous or particulate layer 16. Thus, on separation of webs 12 and 22 after imaging, layer 14 separates in non-exposed regions from surface zone or layer 12b and remains on porous or particulate regions 16b as a protective surface material 14b.

As can be seen from FIG. 2, the relationships of adhesivity and cohesivity among the several layers of imaging medium 10 are such that separation occurs between layer 14 and surface zone or layer 12b in non-exposed regions. Thus, imaging medium 10, if it were to be separated without exposure, would separate between surface zone or layer 12b and layer 14 to provide a $D_{max}$ on sheet 22. The nature of layer 14 is such, however, that its relatively weak adhesion to surface zone or layer 12b can be substantially increased upon exposure. Thus, as shown in FIG. 2, exposure of medium 10 to brief and intense radiation in the direction of the arrows and in the areas defined by the respective pairs of arrows, serves in the areas of exposure to substantially lock or attach layer 14, as portions 14a, to surface zone or layer 12b.

Attachment of weakly adherent layer 14 to surface zone or layer 12b in areas of exposure is accomplished by absorption of radiation within the imaging medium and conversion to heat sufficient in intensity to heat activate surface zone or layer 12b and on cooling to more firmly join exposed regions or portions of layer 14 and surface zone or layer 12b. Thermal imaging medium 10 is capable of absorbing radiation at or near the interface of surface zone or layer 12b of heat-interface activatable polymeric material and intermediate layer 14. This is accomplished by using layers in medium 10 which by their nature absorb radiation and generate the requisite heat for desired thermal imaging, or by including in at least one of the layers, an agent capable of absorbing radiation of the wavelength of the exposing source. Infrared-absorbing dyes can, for example, be suitably employed for this purpose.

If desired, porous or particulate image-forming substance 16 can comprise a pigment or other colorant material such as carbon black which, as is more completely described hereinafter, is absorptive of exposing radiation and which is known in the thermographic imaging field as a radiation-absorbing pigment. Inasmuch as a secure bonding or joining is desired at the interface of layer 14 and surface zone or layer 12b, it is preferred that a light-absorbing substance be incorporated into either or both of intermediate layer 14 and surface zone or layer 12b.

Suitable light-absorbing substances in layers 12b and/or 14, for converting light into heat, include carbon black, graphite or finely divided pigments such as the sulfides or oxides of silver, bismuth or nickel. Dyes such as the azo dyes, xanthene dyes, phthalocyanine dyes or the anthroquinone dyes can also be employed for this purpose. Especially preferred are materials which absorb efficiently at the particular wavelength of the exposing radiation. In this connection, infrared-absorbing dyes which absorb in the infrared-emitting regions of lasers which are desirably used for thermal imaging are especially preferred. Suitable examples of infrared-absorbing dyes for this purpose include the alkylpyrylium-squarylium dyes, disclosed in U.S. Pat. No. 4,508,811 (issued Apr. 2, 1985 to D. J. Gravesteijn, et. al.), and including 1,3-bis[(2,6-di-t-butyl-4H-thiopyran-4-ylidene)methyl]-2,4-dihydroxy-dihydroxidecyclobutene diylium-bis{inner salt}. Other suitable IR-absorbing dyes include 4-[7-(4H-pyran-4-ylide)hepta-1,3,5-trienyl]pyrylium tetraphenylborate and 4-[[3-[7--diethylamino-2-(1,1-dimethylethyl)—(benz[b]-4H-pyran-4-ylidene)methyl]-2-hydroxy-4-oxo-2-cyclobut-en-1-ylidene]methyl]-7-diethylamino-2-(1,1-dimethylethyl)benz[b]pyrylium hydroxide inner salt. These and other IR-absorbing dyes are disclosed in the commonly assigned patent application of Z. J. Hinz, et. al., entitled Heptamethine Pyrylium Dyes, and Processes for Their Preparation and Use as Near Infra-Red Absorbers U.S. Ser. No. 07/616,651, filed of even date; and in the commonly assigned and copending application of S. J. Telfer, et. al., entitled Benzpyrylium Squarylium Dyes, and Processes for Their Preparation and Use, U.S. Ser. No. 07/616,639, filed of even date.

From the standpoint of image resolution or sharpness, it is essential that layers 14 and 16 be disruptible, such that, a sharp separation can occur between exposed and unexposed regions of the thermally imaged medium, through the thickness of the layers and along a direction substantially orthogonal to the interface of the layers, i.e., substantially along the direction of arrows 24, 24', 26 and 26'. This can be accomplished by forming the layer 14 as a discontinuous layer of discrete particles. For example, thermoplastic polymer particles can be applied from an aqueous latex containing the polymeric particles in dispersion. Coating and drying of the latex at temperatures below the softening temperature of the polymeric particles allow the formation of a layer in which separation occurs at the interfaces between particles. Examples of polymeric materials which can be used include poly(methylmethacrylate), poly(vinylidene chloride), poly(vinyl acetate), poly(vinyl chloride), poly(styrene), poly(styrene-co-butadiene), cellulose acetate-butyrate, poly(styrene-co-acrylonitrile), poly(acrylonitrile) and the polyesters of aliphatic polyols, such as ethylene glycol and glycerol, and dicarboxylic acids (and the lower alkyl esters thereof), such as sebacic or adipic acid. If desired, dispersions of polymeric thermoplastic particles can be prepared by introducing an organic solvent, such as methylene chloride, containing dissolved polymer, such as poly(styrene-co-acrylonitrile), into an aqueous medium with agitation, and removing organic solvent to provide a coatable aqueous dispersion.

In the production of thermal imaging medium 10, thermoplastic or resinous layer 14 can be applied onto imaging zone or layer **12*b* using known coating techniques for providing a thin layer of resinous material. Layer 14, as indicated previously, shows a degree of adhesion to surface zone or layer 12*b* which, in general, will be sufficient to prevent accidental dislocation. The degree of adhesion should be such, however, that desired separation in non-exposed regions can be accomplished in the manner shown in FIG. 2. The nature of layer 14 will also be such that its adhesion can be increased substantially in exposed regions as to be firmly attached to web material 12, as also shown in FIG. 2**.

The thickness of layer 14 can vary and, in general, will be of at least such thickness that, upon exposure and separation of images, portions (**14*b*) of layer 14 will be sufficient to confer protection for the surface of image 10*b*. While greater thicknesses will typically provide greater durability and protection, imaging efficiency and sensitivity may be reduced as a consequence of increasing the bulk of material to be heated at the interface of layer 14 and surface zone or layer 12*b***. Good results can be obtained using a layer in the range of about 0.1 micron to five microns, and preferably from about 0.3 micron to one micron.

If desired, various additives such as plasticizers, binders, colorants, softeners or the like can be added. Film-forming binders such as hydroxyethyl cellulose, polyvinylalcohol, poly(styrene-co-maleic anhydride), poly(vinyl butyrate) or the like can be employed. Surfactants, to enhance dispersion of polymeric material or improve coatability, are also desirably included. Lubricity-enhancing agents, such as silicones and waxes, can be included to provide an image **10*b*** having enhanced lubricity and improved durability. Waxes such as carnauba wax and waxy materials such as the polyethylene oxides and low molecular weight polyethylene waxes can be employed for this purpose.

If desired, image **10*b*, after separation of images 10*a* and 10*b*, can be subjected to a heating step to improve durability. Depending upon the particular nature of layer 14, portions thereof (14*b* in FIG. 2) may, by coalescence or fusion, form a more durable and protective surface layer in image 10*b*, and a post-imaging heating step for this purpose will in some instances be preferred. A preferred material for layer 14** is a polymeric latex or dispersion which forms a layer having desirable disruptibility for high-resolution imaging and which in a post-imaging heating step provides a more durable and protective layer.

As indicated, layer 14 is a disruptible layer which allows for sharp separation between exposed and unexposed regions. Disruptability of layer 14 can be the result of including particulate matter in layer 14 to provide a discontinuous character and to assist in such separation. Thus, a layer 14 comprising a thermoplastic resin or wax or wax-like material can include solid particulate matter which serves to reduce the cohesivity of the thermoplastic layer and permit a sharper fracturing of the layer between exposed and unexposed areas. Examples of materials suited for this purpose are silica, clay materials such as kaolin, bentonite and attapulgite, alumina, calcium chloride, and pigments such as carbon black, milori blue, titania and baryta.

Thermoplastic layer 14 may be variously termed an internal or intermediate layer in thermal imaging medium 10, as shown in FIG. 1, or as a protective layer, notwithstanding that the protective attributes of layer 14 will only be manifest after imaging and separation of the respective images shown in FIG. 2, in the form of protective portions **14*b* of layer 14. It will be appreciated that layer 14 is also involved in the attachment of image-forming material in exposed areas at the interface of layer 14 and surface zone or layer 12*b*. In addition, the properties of layer 14 influence the mode of separation in non-exposed regions, as depicted in FIG. 2. It will be appreciated, however, that the requirements thereof will be different from and should be distinguished from the requirements of principal image-forming layer 16 of imaging medium 10**.

Image-forming layer 16 comprises an image-forming substance deposited onto intermediate (or protective) layer 14 as a porous or particulate layer or coating. Layer 16, also referred to as a colorant/binder layer, can be formed from a colorant material dispersed in a suitable binder, the colorant being a pigment or dye of any desired color, and preferably, being substantially inert to the elevated temperatures required for thermal imaging of medium 10. Carbon black is a particularly advantageous and preferred pigment material. Preferably, the carbon black material will comprise particles having an average diameter of about 0.01 to 10 micrometers (microns). Although the description hereof will refer principally to carbon black, other optically dense substances, such as graphite, phthalocyanine pigments and other colored pigments can be used. If desired, substances which change their optical density upon subjection to temperatures as herein described can also be employed.

The binder for the image-forming substance of layer 16 provides a matrix to form the porous or particulate substance thereof into a cohesive layer and serves to adhere layer 16 to intermediate (or protective) layer 14. Layer 16 can be conveniently deposited onto layer 14 (which is carried by web material 12) using any of a number of known coating methods. According to a preferred embodiment, and for ease in coating layer 16 onto layer 14, carbon black particles are initially suspended in an inert liquid vehicle (typically, water) and the resulting suspension or dispersion is uniformly spread over intermediate layer 14. On drying, layer 16 is adhered as a uniform image-forming layer onto the surface of intermediate layer 14. It will be appreciated that the spreading characteristics of the suspension can be improved by including a surfactant, such as ammonium perfluoroalkyl sulfonate, nonionic ethoxylate or the like. Other substances, such as emulsifiers can be used or added to improve the uniformity of distribution of the carbon black in its suspended state and, thereafter, in its spread and dry state. Layer 16 can range in thickness and typically will have a thickness of about 0.1 micron to about 10 microns. In general, it will be preferred from the standpoint of image resolution, that a thin layer be employed. Layer 16 should, however, be of sufficient thickness to provide desired and predetermined optical density in the images prepared from imaging medium 10.

Suitable binder materials for image-forming layer 16 include gelatin, polyvinyl alcohol, hydroxyethyl cellulose, gum arabic, methyl cellulose, polyvinylpyrrolidone, polyethyloxazoline, polystyrene latex and poly(styrene-co-maleic anhydride). The ratio of pigment (e.g., carbon black) to binder can be in the range of from 40:1 to about 1:2 on a weight basis. Preferably, the ratio of pigment to binder will be in the range of from about 4:1 to about 10:1. A preferred binder material for a carbon black pigment material is polyvinylalcohol.

If desired, additional additives or agents can be incorporated into image-forming layer 16. Thus, submicroscopic particles, such as chitin, polytetrafluoroethylene particles and/or polyamide can be added to colorant/binder layer 16 to improve abrasion resistance. Such particles can be present, for example, in amounts of from about 1:2 to about 1:20, particles to layer solids, by weight.

As shown in FIG. 2, exposed regions or portions of layer 16 separate sharply from non-exposed regions. As is the case with layer 14, layer 16 is an imagewise disruptible layer owing to the porous or particulate nature thereof and the capacity for the layer to fracture or break sharply at particle interfaces. In addition, the mode of image separation depicted in FIG. 2 requires that layer 16 have a degree of adhesion to layer 14 in excess of the adhesion of layer 14 to surface zone or layer **12*b*. Thus, layers 14 and 16 can be carried in joined relation as layers 14*b* and 16*b***, respectively, in areas of non-exposure.

Shown in imaging medium 10 is a second sheet-like web material 22 covering image-forming layer 16 through adhesive layer 20 and release layer 18. Web material 22 is laminated over image-forming layer 16 and serves as the means by which non-exposed areas of protective layer 14 and image-forming layer 16 can be carried from web material 12 in the form of image **10*b*, as shown in FIG. 2**.

Preferably, web material 22 will be provided with a layer of adhesive to facilitate lamination. Adhesives of the pressure-sensitive and heat-activatable types can be used for this purpose. Typically, web material 22 carrying adhesive layer 20 will be laminated onto web 12 using pressure (or heat and pressure) to provide a unitary lamination. Suitable adhesives include poly(ethylene-co-vinyl acetate), poly(vinyl acetate), poly(ethylene-co-ethylacrylate), poly(ethylene-co-methacrylic acid) and polyesters of aliphatic or aromatic dicarboxylic acids (or their lower alkyl esters) with polyols such as ethylene glycol, and mixtures of such adhesives.

The properties of adhesive layer 20 can vary in softness or hardness to suit particular requirements of handling of the laminar medium during manufacture and use and image durability. A soft adhesive material of suitable thickness to provide the capability of absorbing stresses that may cause an undesired delamination can be used, as is disclosed and claimed in the aforementioned patent application of Neal F. Kelly, U.S. Ser. No. 07/616,854. If desired, a hardenable adhesive layer can be used and cutting or other manufacturing operations can be performed prior to hardening of the layer, as is described in the commonly assigned patent application of Neal F. Kelly, et al., for Hardenable Adhesive for Thermal Imaging Medium, U.S. Ser. No. 07/616,853, filed of even date.

According to a preferred embodiment, and as shown in FIG. 1, a release layer 18 is included in thermal imaging 10 to facilitate separation of images **10*a* and 10*b* according to the mode shown in FIG. 2. As described hereinbefore, regions of medium 10 subjected to radiation become more firmly secured to surface zone or layer 12*b* by reason of the heat activation of layer 12 by the exposing radiation. Non-exposed regions of layer 14 remain only weakly adhered to surface zone or area 12*b* and are carried along with web 22 on separation of web materials 12 and 22. This is accomplished by the adhesion of layer 14 to surface zone or layer 12*b*, in non-exposed regions, being less than: (a) the adhesion between layers 14 and 16; (b) the adhesion between layers 16 and 18; (c) the adhesion between layers 18 and 20; (d) the adhesion between layers 20 and 22; and (e) the cohesivity of layers 14, 16, 18 and 20. The adhesion of web material 22 to porous or particulate layer 16, while sufficient to remove non-exposed regions of intermediate layer 14 and porous and particulate layer 16 from web surface zone or layer 12***b*, is controlled, in exposed areas, by release layer 18 so as to prevent removal of firmly attached exposed portions of layers 14*a* and 16*a* (attached to surface zone or layer 12*b* by exposure and by heat activation thereof).

Release layer 18 is designed such that its cohesivity or its adhesion to either adhesive 20 or porous or particulate layer 16 is less, in exposed regions, than: (a) the adhesion of layer 14 to surface zone or layer 12*b*; and (b) the adhesion of layer 14 to layer 16. The result of these relationships is that release layer 20 undergoes an adhesive failure in exposed areas at the interface between layers 18 and 20, or at the interface between layers 18 and 16; or, as shown in FIG. 2, a cohesive failure of layer 18 occurs, such that portions (18*b*) are present in image 10*b* and portions (18*a*) are adhered in exposed regions to porous or particulate layer 16. Portions 18*a* of release layer 18 serve to provide surface protection for the image areas of image 10*a*, against abrasion and wear.

Release layer 18 can comprise a wax, wax-like or resinous material. Microcrystalline waxes, for example, high-density polyethylene waxes available as aqueous dispersions, can be used for this purpose. Other suitable materials include carnauba, beeswax, paraffin wax and wax-like materials such as poly(vinylstearate), polyethylene sebacate, sucrose polyesters, polyalkylene oxides and dimethylglycol phthalate. Polymeric or resinous materials such as poly(methylmethacrylate) and copolymers of methyl methacrylate and monomers copolymerizable therewith can be employed. If desired, hydrophilic colloid materials, such as polyvinylalcohol, gelatin or hydroxyethyl cellulose can be included as polymer binding agents.

Resinous materials, typically coated as latices, can be used and latices of poly(methyl methacrylate) are especially useful. Cohesivity of layer 18 can be controlled so as to provide the desired and predetermined fractioning. Waxy or resinous layers which are disruptible and which can be fractured sharply at the interfaces of particles thereof can be used to advantage. If desired, particulate materials can be added to the layer to reduce cohesivity. Examples of such particulate materials include, silica, clay particles and particles of poly(tetrafluoroethylene).

Thermal imaging laminar medium 10 can be imaged by creating (in medium 10) a thermal pattern according to the information imaged. Exposure sources capable of providing radiation which can be imaged onto medium 10, and which can be converted by absorption into a predetermined pattern, can be used. Gas discharge lamps, Xenon lamps and lasers are examples of such sources.

The exposure of medium 10 to radiation can be progressive or intermittent. For example, a two-sheet laminar medium, as shown in FIG. 1, can be fastened onto a rotating drum for exposure of the medium through web material 12. A light spot of high intensity, such as is emitted by a laser, can be used to expose the medium 10 in the direction of rotation of the drum, while the laser is moved slowly in a transverse direction across the web, thereby to trace out a helical path. Laser drivers, designed to fire corresponding lasers, can be used to intermittently fire one or more lasers in a predetermined manner to thereby record information according to an original to be imaged. As is shown in FIG. 1, a pattern of intense radiation can be directed onto medium 10 by exposure to a laser from the direction of the arrows 24 and 24' and 26 and 26', the areas between the respective pairs of arrows defining regions of exposure.

If desired, a thermal imaging laminar medium of the invention can be imaged using a moving slit or stencils or masks, and by using a tube or other source which emits radiation continuously and which can be directed progressively or intermittently onto medium 10. Thermographic copying methods can be used, if desired.

Preferably, a laser or combination of lasers will be used to scan the medium and record information in the form of very fine dots or pels. Semiconductor diode lasers and YAG lasers having power outputs sufficient to stay within upper and lower exposure threshold values of medium 10 will be preferred. Useful lasers may have power outputs in the range of from about 40 milliwatts to about 1000 milliwatts. An exposure threshold value, as used herein, refers to a minimal power required to effect an exposure, while a maximum power output refers to a power level tolerable by the medium before "burn out" occurs. Lasers are particularly preferred as exposing sources inasmuch as medium 10 may be regarded as a threshold-type of film; i.e., it possesses high contrast and, if exposed beyond a certain threshold value, will yield maximum density, whereas no density will be recorded below the threshold value. Especially preferred are lasers which are capable of providing a beam sufficiently fine to provide images having resolution as fine as one thousand (e.g., 4,000 to 10,000) dots per centimeter.

Locally applied heat, developed at or near the interface of intermediate layer 14 and surface zone or layer 12*b* can be intense (about 400° C.) and serves to effect imaging in the manner aforedescribed. Typically, the heat will be applied for an extremely short period, preferably in the order of $<0.5$ microsecond, and exposure time span may be less than one millisecond. For instance, the exposure time span can be less than one millisecond and the temperature spanin exposed regions can be between about 100° C. and about 1000° C.

Apparatus and methodology for forming iamges from thermally actuatable media such as the medium of the present invention are described in detail in the commonly assigned patent application of E. B. Cargill, et al., entitled, Printing Apparatus, U.S. Ser. No. 07/616,658, filed of even date; and in the commonly assigned patent application of J. A. Allen, et al., entitled, Printing Apparatus and Method, U.S. Ser. No. 07/616,786, filed of even date.

The imagewise exposure of medium 10 to radiation creates in the medium latent images which are viewable upon separation of the sheets thereof (12 and 22) as shown in FIG. 2. Sheet 22 can comprise any of a variety of plastic, paper or other materials, depending upon the particular application for image 10*b*. Thus, a paper sheet material 22 can be used to provide a reflective image. In many instances, a transparency sheet material preferred, in which case, a transparent sheet material 22 will be employed. A polyester (e.g., polyethylene terephthalate) sheet material is a preferred material for this purpose. Preferably, each of sheet-like web materials 12 and 22 will be flexible polymeric sheets.

The thermal imaging medium of the invention is especially suited to the production of hardcopy images produced by medical imaging equipment such as x-ray equipment, CAT scan equipment, MR equipment, Ultrasound equipment and so forth. As is stated in Neblette's handbook of Photography and Reprography, Seventh Edition, Edited by John M. Sturge, Van Nostrand and Reinhold Company, at pp. 558–559;: "The most important sensitometric difference between x-ray films and films for general photography is the contrast. X-ray films are designed to produce high contrast because the density differences of the subject are usually low and increasing these differences in the radiograph adds to its diagnostic value . . . Radiographs ordinarily contain densities ranging from 0.5 to over 3.0 and are most effectively examined on an illuminator with adjustable light intensity . . . Unless applied to a very limited density range the printing of radiographs on photographic paper is ineffective because of the narrow range of density scale of papers." The medium of the present invention can be used to advantage in the production of medical iamges using printing apparatus, as described in the aforementioned U.S. application of E. B. Cargill, et al., U.S. Ser. No. 07/616,658, which is capable of providing a large number of gray scale levels.

The use of a high number of gray scale levels is most advantageous at high densities since, as has been mentioned previously, the psychophysical nature of human vision is most sensitive to gray scale changes which occur at high density. Specifically, the human visual system is sensitive to relative change in luminance as a function of dL/L where dL is the change in luminance and L is the average luminance. Thus, when the density is high, i.e., L is small, the sensitivity is high for a given dL whereas if the density is low, i.e., L is large, then the sensitivity is low for a given dL. In accordance with this, the medium of the present invention is especially suited to utilization with equipment capable of providing small steps between gray scale levels at the high end of the gray scale, i.e., in the high contrast region of greatest value in diagnostic imaging. Further, it is desirable that the high density regions of the gray scale spectrum be rendered as accurately as possible, inasmuch as the eye is more sensitive to errors which occur in that region of the spectrum.

The medium of the present invention is especially suited to the production of high density images as image 10*b*, shown in FIG. 2. It has been noted previously that separation of sheets 12 and 22 without exposure, i.e., is in an unprinted state, provides a totally dense image in colorant material on sheet 22 (image 10*b*). The making of a copy entails the use of radiation to cause the image-forming colorant material to be firmly attached to web 12. Then, when sheets 12 and 22 are separated, the exposed regions will adhere to web 12 while unexposed regions will be carried to sheet 22 and provide the desired high density image 10*b*. Since the high density image provided on sheet 22 is the result of "writing" on sheet 12 with a laser to firmly anchor to sheet 12 (and prevent removal to sheet 22) those portions of the colorant material which are unwanted in image 10*b*, it will be seen that the amount of laser actuation required to produce a high density image can be kept to a minimum. A method of providing a thermal image while keeping exposure to a minimum is disclosed and claimed in the commonly assigned patent application of M. R. Etzel, entitled, Printing Method, U.S. Ser. No. 07/616,406, filed of even date.

If medium 10 were to be exposed in a manner to provide a high density image on sheet 12, it will be appreciated that the high density gray scale levels would be written on sheet 12 with a single laser at an inefficient scanning speed or by the interaction of a number of lasers, increasing the opportunity for tracking error. Because medical images are darker than picture photographs and tracking errors are more readily detected in the high density portion of gray scale levels, a printing apparatus, using medium 10, would need to be complex and expensive to achieve a comparable level of accuracy in the production of a high density medical image on sheet 12 as can be achieved by exposing the medium for production of the high density image on sheet 22.

The following examples are presented for purposes of illustrating the invention but are not to be taken as limiting the invention. All parts, ratios and proportions, except where otherwise indicated, are by weight.

EXAMPLE 1

Onto a first sheet of polyethylene terephthalate of 1.5-mil(0.038 mm) thickness were deposited the following layers, in succession:

a 0.5-micron thick, heat-activatable layer of poly(styrene-co-acrylonitrile);

a 0.5-micron thick, thermoplastic intermediate layer comprising four parts of a 96/4 mixture of 62.9/33.6/3.5 poly(methylmethacrylate-co-butylmethacrylate-co-methacrylic acid) and sodium diethylhexyl sulfosuccinate surfactant, one part of an infrared-absorbing organic dye (CAS-3599-32-4, available as EK-125 from Eastman Kodak Company), and 0.6 part PVA, i.e., polyvinylalcohol (the layer being prepared by adding the IR dye and PVA binder to a latex of the terpolymer and surfactant, coating and drying);

a 0.75-micron thick layer of carbon black pigment and PVA binder, at a ratio of 5:1; and a 0.5-micron thick release layer comprising ten parts of a 96/4 mixture of 62.9/33.6/3.5 poly(methylmethacrylate-co-butylmethacrylate-co-methacrylic acid) and sodium diethylhexyl sulfosuccinate, ten parts silica and one part PVA.

Onto a second sheet of polyethylene terephthalate of seven-mil(0.178 mm) thickness was deposited a layer of heat-activatable adhesive, coated from a solution of a thermoplastic copolyester resin, available as Vitel PE-200 resin from Goodyear Chemicals Division of The Goodyear Tire and Rubber Company and having a sealing temperature of about 205° F.(90.6° C.), dissolved in methylethyl ketone and toluene. The layer on drying was a ten-micron thick adhesive layer.

The aforedescribed polyethylene terephthalate sheet materials were brought into face-to-face superposition and passed through a pair of heated rolls to provide a laminar thermally actuatable imaging element of the invention, having the structure shown in FIG. 1.

EXAMPLE 2

Onto a first sheet of polyethylene terephthalate of 1.75-mil(0.044 mm) thickness were deposited the following layers, in succession:

a 0.5-micron thick, heat-activatable layer of poly(styrene-co-acrylonitrile) and 1,3-bis[2,6-di-t-butyl-4H-thiopyran-4-ylidene)methyl]-2,4-dihydroxydihydroxide-cyclobutene diylium-bis(inner salt), at a ratio of 7:1;

a 0.75-micron thick, thermoplastic intermediate layer comprising four parts of 60/40 poly(methylmethacrylate-co-ethylmethacrylate) having a glass transition temperature (Tg) of 45° C. (available as Hycar-26256 latex from The B.F. Goodrich Company), one part of high-density polyethylene wax having a melting point of about 130° C. and a molecular weight in the range of about 8,000 to 10,000 (available as a neutral wax dispersion, Michelman-32535, from Michelman Chemicals, Inc.) and 0.6 part of poly(styrene-co-maleic anhydride) binder (SMA), available as Scripset 540 from Monsanto Company (the layer being prepared by adding the wax dispersion and SMA binder to the Hycar latex, coating and drying);

a 0.8-micron thick layer of carbon black pigment and PVA, at a ratio of 5:1; and a 0.8-micron thick release layer comprising high-density polyethylene wax (from Michelman-32535 wax dispersion), silica and PVA, at ratios of 10:10:1.

A second polyethylene terephthalate sheet of seven-mil(0.178 mm) thickness was provided with a ten-micron thick layer of Vitel PE-200 adhesive, in the manner described in EXAMPLE 1. The resulting sheet was laminated to the coated first sheet of this example, in the same manner as is described in EXAMPLE 1, to provide a laminar, thermally actuatable imaging element of the invention.

EXAMPLE 3

A laminar, thermally actuatable imaging element was prepared by coating and laminating together first and second polyethylene terephthalate sheets in the manner described in EXAMPLE 1, except that, in place of the thermoplastic intermediate layer used in the first sheet thereof, there was employed a one-micron thermoplastic intermediate layer comprising: four parts of a 7/1/0.7 mixture of poly(styrene-co-acrylonitrile), 1,3-bis[2,6-di-t-butyl-4H-thiopyran-4-ylidene(methyl]-2,4-dihydroxydihydroxide-cyclobutene diylium-bis(inner salt), and sodium dodecylbenzene sulfonate; one part high-density polyethylene wax; and 1.2 parts of PVA (the layer being obtained by preparing a methylene chloride dispersion of the poly(styrene-co-acrylonitrile) and the IR-dye; adding water and the sodium dodecylbenzene sulfonate surfactant, to provide an aqueous dispersion of polymer particles; evaporating (removing) methylene chloride solvent; adding Michelman-32535 wax dispersion and PVA binder; and coating and drying to a thermoplastic intermediate layer of one-micron thickness).

EXAMPLE 4

Onto a first sheet of polyethylene terephthalate of 1.5-mil(0.038 mm) thickness were deposited the following layers, in succession:

a 0.5-micron thick heat-activatable layer of poly(styrene-co-acrylonitrile);

a 0.75-micron thick, thermoplastic intermediate layer comprising: four parts poly(methylmethacrylate-co-n-butylmethacrylate), having a Tg of 60° C. and available as Acryloid B-44 polymer from Rohm and Haas Company; 0.4 part sodium dodecylbenzene sulfonate (SDBS) surfactant; 0.8 part of 1,3-bis[2,6-di-t-butyl-4H-thiopyran-4-ylidene)methyl]-2,4-dihydroxydihydroxide-cyclobutene diylium-bis(inner salt); one part high-density polyethylene wax, from Michelman-32535 wax dispersion; and 1.2 parts SMA binder (the layer being obtained by preparing a methylene chloride dispersion of the B-44 polymer and the IR dye; adding water and the SDBS surfactant, to provide an aqueous dispersion of polymer particles; evaporating (removing) methylene chloride solvent; adding the Michelman wax dispersion and SMA binder; and coating and drying);

a 0.75-micron thick layer of carbon black pigment and PVA, at a ratio of 5:1; and a 0.5-micron thick release layer comprising: ten parts high-density polyethylene wax (from Michelman-32535 wax dispersion); ten parts silica; and one part SMA binder.

A second sheet, polyethylene terephthalate of seven-mil(0.178 mm) thickness, was provided with a ten-micron thick layer of Vital PE-200 adhesive, in the manner described in EXAMPLE 1. The respective first and second sheets were laminated together in the manner described in EXAMPLE 1, to provide a laminar thermally actuatable imaging element of the invention.

EXAMPLE 5

Onto a first sheet of polyethylene terephthalate of 1.75-mil(0.044 mm) thickness were deposited the following layers, in succession:

a 0.5-micron thick heat-activatable layer of poly(styrene-co-acrylonitrile);

a 0.5-micron thick, thermoplastic intermediate layer comprising: 3.4 parts poly(methylmethacrylate-co-n-butylmethylmethacrylate), having a Tg of 60° C. and available as Acryloid B-44 polymer from Rohm and Haas Company; 0.34 part SDBS surfactant; 0.68 part of 1,3-bis[2,6-di-t-butyl-4H-thiopyran-4-ylidene)methyl]-2,4-dihydroxy-dihydroxide-cyclobutene diylium-bis(inner salt); one part high-density polyethylene wax having a melting point of about 130° C. and a molecular weight in the range of about 8,000 to 10,000, from Michelman-42540 anionic-emulsified wax dispersion; and 1.5 parts SMA binder (the layer being obtained by the procedure described in EXAMPLE 4 for production of the intermediate layer thereof);

a 0.8-micron thick layer of carbon black pigment and PVA, at a ratio of 5:1; and a 0.15-micron thick release layer comprising high-density polypropylene wax having a melting point of about 100° C. and a molecular weight in the range of about 8,000 to 10,000 (from Michelman-79130 neutral wax dispersion), silica and PVA, at ratios of 10:10:1.

A second polyethylene terephthalate sheet of seven-mil(0.178 mm) thickness was provided with a ten-micron thick layer of Vitel PE-200 adhesive, in the manner described in EXAMPLE 1. The resulting sheet was laminated to the coated first sheet of this example, in the same manner as is described in EXAMPLE 1, to provide a laminar, thermally actuatable imaging element of the invention.

EXAMPLE 6

Onto a first sheet of polyethylene terephthalate of 1.75-mil(0.044 mm) thickness were deposited the following layers, in succession:

a 4.2-micron thick stress-absorbing layer of polyurethane (ICI XR-9619, ICI Resins US, Wilmington, Mass.);

a one-micron thick heat-activatable layer of poly(styrene-co-acrylonitrile);

a 0.5-micron thick, thermoplastic intermediate layer comprising 1.8 parts Vitel PE-200 copolyester; 0.18 part SDBS surfactant; 0.53 part high-density polyethylene wax having a melting point of about 100° C. and a molecular weight in the range of 8,000 to 10,000 (available as a wax dispersion, Michelman-42540); 0.79 part SMA binder; and 0.26 part IR dye,4-[[3-[7-diethylamino-2-(-1,1-dimethylethyl)-(benz[b]-4H-pyran-4-ylidene)methyl]-2-hydroxy-4-oxo-2-cyclobuten-1-ylidene]methyl]-7-diethylamino-2-(1,1-dimethylethyl)benz[b]pyrylium hydroxide inner salt dye (the layer being obtained by preparing a methylene chloride dispersion of the Vitel PE-200 copolyester and the IR-dye; adding water and SDBS surfactant to provide as aqueous dispersion of polymer particles; evaporating (removing) methylene chloride solvent; adding Michelman-42540 wax dispersion and the SMA binder; and coating and drying to a thermoplastic intermediate layer of 0.5-micron thickness);

a 0.8-micron thick layer of carbon black pigment and PVA, at a ratio of 5:1; and a 0.3-micron thick release layer comprising: ten parts high-density polyethylene wax (from Michelman-32535 wax dispersion); ten parts silica; and one part SMA binder.

A second polyethylene terephthalate sheet of seven-mil(0.178 mm) thickness was provided with a ten-micron thick layer of Vitel PE-200 adhesive, in the manner described in EXAMPLE 1. The resulting sheet was laminated to the coated first sheet of this example, in the same manner as is described in EXAMPLE 1, to provide a laminar, thermally actuatable imaging element of the invention.

EXAMPLE 7

Onto a first sheet of polyethylene terephthalate of 1.75-mil(0.044 mm) thickness were deposited the following layers, in succession:

a 4.2-micron thick stress-absorbing polyurethane layer comprising ICI XR-9619 polyurethane (ICI Resins US, Wilmington, Mass.);

a one-micron thick heat-activatable layer of poly(styrene-co-acrylonitrile);

a 0.3-micron thick, thermoplastic intermediate layer comprising: 3.4 parts poly(methylmethacrylate-co-n-butylmethacrylate) having a Tg of 60° C. and available as Acryloid B-44 polymer from Rohm and Haas Company; 0.34 part SDBS surfactant; 0.68 part of 1,3-bis[2,6-di-t-butyl-4H-thiopyran-4-ylidene)methyl]-2,4-dihydroxydihydroxide-cyclobutene diylium-bis(inner salt); one part high-density polyethylene wax, from Michelman-42540 anionic wax dispersion; and 1.5 parts SMA binder (the layer being obtained by the procedure described in EXAMPLE 4 for the production of the intermediate layer thereof);

a 0.8-micron thick layer of carbon black pigment and PVA, at a ratio of 5:1; and a 0.3-micron thick release layer comprising: ten parts high-density polyethylene wax (from Michelman-32535 neutral wax dispersion); ten parts silica; and one part SMA binder.

A second sheet, polyethylene terephthalate of seven-mil(0.178 mm) thickness, was provided with a ten-micron thick layer of Vitel PE-200 adhesive, in the manner described in EXAMPLE 1. The respective first and second sheets were laminated together in the manner described in EXAMPLE 1, to provide a laminar thermally actuatable imaging element of the invention.

EXAMPLE 8

Onto a first sheet of polyethylene terephthalate of 1.75-mil(0.044 mm) thickness were deposited the following layers, in succession:

a 0.5-micron thick heat-activatable layer of poly(styrene-co-acrylonitrile);

a 0.75-micron thick, thermoplastic intermediate layer comprising four parts of 60/40 poly(methylmethacrylate-co-ethylmethacrylate) having a glass transition temperature (Tg) of 45° C. (available as Hycar-26256 latex from The B.F. Goodrich Company), one part of high-density polyethylene wax having a molecular weight in the range of about 8,000 to 10,000 (available as Michelman-32535 neutral wax dispersion from Michelman Chemicals, Inc.), and 0.61 part of SMA binder (the layer being obtained by the procedure described in EXAMPLE 2 for the production of the layer thereof);

a 0.8-micron thick layer of carbon black pigment and PVA, at a ratio of 5:1; and a 0.5-micron thick release layer comprising, by weight: ten parts of a 96/4 mixture of 62.9/33.6/3.5 poly(methylmethacrylate-co-butylmethacrylate-co-methacrylic acid) and sodium diethylhexyl sulfosuccinate; ten parts silica; and one part PVA.

A second polyethylene terephthalate sheet of seven-mil(0.178 mm) thickness was provided with a ten-micron thick layer of Vitel PE-200 adhesive, in the manner described in EXAMPLE 1. The resulting sheet was laminated to the coated first sheet of this example, in the same manner as is described in EXAMPLE 1, to provide a laminar, thermally actuatable imaging element of the invention.

EXAMPLE 9

Onto a first sheet of polyethylene terephthalate of 1.75-mil(0.044 mm) thickness were deposited the following layers, in succession:

a 4.2-micron thick polyurethane stress-absorbing layer comprising ICI XR-9619 polyurethane;

a one-micron thick heat-activatable layer of poly(styrene-co-acrylonitrile);

a 0.5-micron thick, thermoplastic intermediate layer comprising: 3.4 parts poly(methylmethacrylate-co-n-butylmethacrylate) having a Tg of 60° C. and available as Acryloid B-44 polymer from Rohm and Haas Company; 0.34 part SDBS surfactant; 0.68 part of 1,3-bis[2,6-di-t-butyl-4H-thiopyran-4-ylidene)methyl]-2,4-dihydroxydihydroxide-cyclobutene diylium-bis(inner salt); one part high-density polyethylene wax, from Michelman-32535 anionic-emulsified wax dispersion; and 1.5 parts SMA binder (the layer being obtained by the procedure described in EXAMPLE 4 for the production of the intermediate layer thereof);

a 0.8-micron thick layer of carbon black pigment and PVA, at a ratio of 5:1;

a 0.3-micron thick release layer comprising: ten parts high-density polyethylene wax (from Michelman-32535 neutral wax dispersion); ten parts silica; and one part SMA binder; and a one-micron thick adhesive layer comprising Hycar-26256 poly(methylmethacrylate-co-ethylmethacrylate); PVA; high-molecular weight poly(acrylic acid), available as Carbopol 941, The B.F. Goodrich Company; and modified melamine resin crosslinking agent, available as Cymel 385, American Cyanamid Company, at ratios, respectively, of 45:1:1:3.

A second sheet, polyethylene terephthalate of seven-mil(0.178 mm) thickness, was provided with a ten-micron thick layer of Vitel PE-200 adhesive, in the manner described in EXAMPLE 1. The respective adhesive layers of the first and second sheets were brought into face-to-face contact and the sheets were laminated together in the manner described in EXAMPLE 1, to provide a laminar thermally actuatable imaging element of the invention.

EXAMPLE 10

Onto a first sheet of polyethylene terephthalate of 1.5-mil(0.038 mm) thickness were deposited the layers, in succession:

a 0.2-micron thick heat-activatable layer of a 7:1 mixture of poly(styrene-co-acrylonitrile) and 4-[7-(4H-pyran-4-ylide)hepta-1,3,5-trienyl]pyrylium tetraphenylborate;

a one-micron thick, thermoplastic intermediate layer comprising: four parts poly(methylmethacrylate) (from Hycar-26256 latex); one part high-density polyethylene wax (from Michelman-32535 neutral wax dispersion); and 0.6 part SMA binder (the layer being obtained by the procedure described in EXAMPLE 2 for the production of the intermediate layer thereof);

a 0.75-micron thick layer of carbon black pigment and PVA, at a ratio of 5:1; and a 0.5-micron thick release layer comprising: ten parts high-density polyethylene wax (from Michelman-32535 wax dispersion); ten parts silica; and one part PVA.

A second sheet, polyethylene terephthalate of seven-mil(0.178 mm) thickness was provided with a ten-micron thick layer of Vitel PE-200 adhesive, in the manner described in EXAMPLE 1. The respective first and second sheets were laminated together in the manner described in EXAMPLE 1, to provide a laminar, thermally actuatable imaging element of the invention.

EXAMPLE 11

Onto a first sheet of polyethylene terephthalate of 1.5-mil(0.038 mm) thickness were deposited the following layers, in succession:

a 0.5-micron thick heat-activatable layer of poly(styrene-co-acrylonitrile);

a 0.5-micron thick, thermoplastic intermediate layer comprising: 3.4 parts copolyester (from Vitel PE-200 copolyester); 0.34 part SDBS surfactant; one part high-density polyethylene wax (from Michelman-32535 neutral wax dispersion); and 1.5 parts PVA (the layer being obtained by the procedure described in EXAMPLE 6 for the production of the intermediate layer thereof, except that, PVA binder was used and IR dye was omitted);

a 0.75-micron thick layer of carbon black pigment and PVA, at a weight ratio of 5:1; and a 0.5-micron thick release layer comprising by weight: ten parts of a 96/4 mixture of 62.9/33.6/3.5 poly(methylmethacrylate-co-butylmethacrylate-co-methacrylatic acid) and sodium diethylhexyl sulfosuccinate surfactant; ten parts silica; and one part PVA.

A second sheet, polyethylene terephthalate of seven-mil(0.178 mm) thickness was provided with a ten-micron thick layer of Vitel PE-200 adhesive, in the manner described in EXAMPLE 1. The respective first and second sheets were laminated together in the manner described in EXAMPLE 1, to provide a laminar thermally actuatable imaging element of the invention.

CONTROL EXAMPLE

For purposes of comparison with thermally actuatable imaging elements of the invention, a control imaging element containing no thermoplastic intermediate layer was prepared. The control element was a laminar thermally actuatable imaging element prepared in the following manner:

Onto a first sheet of polyethylene terephthalate of 1.75-mil(0.044 mm) thickness were deposited the following layers, in succession:

a 0.5-micron thick heat-activatable layer of poly(styrene-co-acrylonitrile);

a 0.8-micron thick layer of carbon black pigment and PVA, at a ratio of 5:1; and a 0.4-micron thick release layer comprising: ten parts high-density polyethylene wax (from Michelman-32535 neutral wax dispersion); ten parts silica; and one part SMA binder.

A second polyethylene terephthalate sheet of seven-mil(0.178 mm) thickness was provided with a ten-micron thick layer of Vitel PE-200 adhesive, in the manner described in EXAMPLE 1. The resulting sheet was laminated to the aforedescribed first sheet, in the same manner as is described in EXAMPLE 1, to provide a control thermally actuatable imaging element.

EXAMPLE 12

The laminar imaging elements of EXAMPLES 1 to 11 and of the CONTROL EXAMPLE were imaged by laser exposure (through the thinner of the polyester sheets thereof) using high intensity semiconductor lasers. In each case, the laminar imaging element was fixed (clamped) to a rotary drum with the seven-mil polyester component thereof facing the drum. The radiation of semiconductor lasers was directed through the 1.5-mil (or 1.75-mil) polyester component thereof in an imagewise manner in response to a digital representation of an original image to be recorded in the thermally actuatable imaging element. After exposure to the high-intensity radiation (by scanning of the imaging element orthogonally to the direction of drum rotation) and removal of the thus-exposed imaging element from the drum, the respective sheets of the imaging elements were separated to provide a first image on the first (1.5-mil or 1.75-mil) polyester sheet and a second (and complementary) image on the second (7-mil) polyester sheet (the principal image).

In each instance, the principal images were evaluated by a fingernail test, according to which, the observer would apply a fingernail to the surface of each image, and after oft-repeated stroking under pressure purposefully to mar the image surface, would examine the image surface visually to determine the effects thereof. In each instance, the principal image provided by the imaging elements of EXAMPLES 1 to 11 (each such image having a protective overcoat layer provided by the thermoplastic intermediate layer) showed little or no surface marring. The principal image provided by the , imaging element of the CONTROL EXAMPLE showed considerable (severe) physical damage and poor durability in fingernail testing. The surface carbon black of the image was scraped away readily by minimal fingernail stroking.

EXAMPLE 13

Samples of principal image provided by the laminar imaging elements of EXAMPLES 2 and 5 to 9 and the CONTROL EXAMPLE were evaluated for durability and abrasion resistance by a testing procedure using a stylus applied under predetermined pressure and stroked across the image surface. All samples were evaluated using a stroking device (Crockmeter, Model CM-5, available from Atlas Electric Devices Company) comprising a light-transmissive platform for receipt of the sample to be tested, a moveable arm equipped with a stylus (0.2 mm in diameter and having a radius of curvature of 18.5 mm) in contact with the image surface, a weight (315 grams) for application of stylus pressure, means for back-and-forth traversal of the arm and stylus over a predetermined straightline path (a distance of 51 mm, constituting one stroke), means for recording the number of strokes, and a light source for transmission . of light through the platform and through the abraded sample thereon. Strips of each of the principal images of EXAMPLES 2, and 5 to 9 (and of the CONTROL EXAMPLE) were evaluated using the aforementioned device. The images to be tested were cut into strips of about 2 in. ×5 in. (51 mm×76 mm) and were heated in an oven for ten seconds at 150° C., prior to testing. All samples were subjected to the abrading force of the arm and stylus reciprocated across the image surface in the area of maximum density, until light transmission through the abraded sample could be observed visually. The number of strokes required to permit the observed light transmission was recorded as indicative of image surface durability. The results of the evaluation are reported in the following Table I.

TABLE I

| EXAMPLE | Number of Crockmeter Strokes |
|---|---|
| 2 | 300 |
| 5 | 46 |
| 6 | 42 |
| 7 | 25 |
| 8 | 175 |
| 9 | 17 |
| CONTROL | 3 |

As can be seen from the results reported in Table I, the imaging elements of EXAMPLES 2 and 5 to 9 provided images having a higher level of durability (resistance to abrasion) that the image provided by the imaging element of the CONTROL EXAMPLE.

EXAMPLE 14

Samples of principal image provided by the laminar imaging elements of EXAMPLES 2, 5, 6, 7, and 9 (and the CONTROL EXAMPLE) were evaluated for solvent resistance. Test strips were evaluated after exposure to either of the following: water; isopropyl alcohol (isopropanol); or a commercially available polymeric gel-like composition intended for application topically to the skin in ultrasound medical diagnostic procedures. A cloth wetted with water (or with isopropyl alcohol or ultrasound gel) was hand rubbed across the image area until carbon was removed therefrom. The number of strokes to effect carbon removal was recorded. The results of the aforedescribed solvent tests are reported as follows in Table II.

TABLE II

| | Number of Solvent Rubbing Strokes | | |
|---|---|---|---|
| EXAMPLE | Water | Isopropanol | Ultrasound Gel |
| 2 | 30 | 25 | — |
| 5 | 30 | 5 | 25 |
| 6 | 5 | 2 | 8 |
| 7 | 30 | 4 | 30 |
| 9 | 15 | 4 | 23 |
| CONTROL | 1 | 1 | 2 |

As can be seen from the results reported in Table II, imaging elements of EXAMPLES 2, 5 to 7 and 9 provided images having a greater resistance to the solvent materials therein described that an image obtained from the imaging element of the CONTROL EXAMPLE.

What is claimed is:

1. A thermal imaging laminar medium, actuatable in response to intense image-forming radiation for production of an image, said laminar medium comprising, in order:

a first sheet, said sheet being transparent to said image-forming radiation and having at least a surface zone or layer of polymeric material heat-activatable upon subjection of said thermal imaging medium to brief and intense radiation;

a thermoplastic intermediate layer having cohesivity in excess of its adhesivity for said surface zone or layer of heat-activatable polymeric material;

an image-forming layer on said thermoplastic intermediate layer, said image-forming layer comprising an image-forming colorant material in a binder therefor, said image-forming layer having adhesivity for said thermoplastic intermediate layer in excess of the adhesivity of said thermoplastic intermediate layer for said surface zone or layer of heat-activatable polymeric material; and a second sheet covering said image-forming layer and laminated directly or indirectly to said image-forming layer;

said thermal imaging medium being capable of absorbing radiation at or near the interface of said surface zone or layer of heat-activatable polymeric material and said thermoplastic intermediate layer, at the wavelength of the exposing source, and being capable of converting absorbed energy into thermal energy of sufficient intensity to heat activate said surface zone or layer rapidly; said heat-activated surface zone or layer, upon rapid cooling, attaching said thermoplastic intermediate layer firmly to said first sheet;

said thermal imaging medium being adapted to image formation by imagewise exposure of portions of said thermal imaging medium to radiation of sufficient intensity to attach exposed portions of said thermoplastic intermediate layer and said image-forming layer firmly to said first sheet and by removal to said second sheet upon separation of said first and second sheets after said imagewise exposure, of unexposed portions of said image-forming layer and said thermoplastic intermediate layer, thereby to provide first and second images, respectively, on said first and second sheets;

said thermoplastic intermediate layer providing surface protection for said second image on said second sheet.

2. The thermal imaging laminar medium of claim 1 wherein said thermoplastic intermediate layer comprises a discontinuous layer of discrete particles, said layer being a disruptible layer adapted to sharp separation between exposed and unexposed regions.

3. The thermal imaging laminar medium of claim 2 wherein said disruptible layer is formed from a polymeric latex or dispersion.

4. The thermal imaging laminar medium of claim 2 wherein said disruptible layer comprises a thermoplastic layer containing solid particulate matter to provide a discontinuous character and to assist in said sharp separation.

5. The thermal imaging laminar medium of claim 2 wherein said disruptible layer comprises a layer formed from an aqueous polymeric latex.

6. The thermal imaging laminar medium of claim 5 said disruptible layer includes a lubricity-enhancing agent.

7. The thermal imaging laminar medium of claim 6 wherein said lubricity-enhancing agent comprises a wax.

8. The thermal imaging laminar medium of claim 5 wherein said disruptible layer includes a light-absorbing substance capable of absorbing radiation at or near the interface of said layer and said surface zone or layer of heat-activatable polymeric material.

9. The thermal imaging laminar medium of claim 8 wherein said light-absorbing substance comprises an infrared-absorbing dye.

10. The thermal imaging laminar medium of claim 1 wherein said first sheet comprises a polymeric sheet having thereon a surface layer of a heat-activatable polymeric material that can be heat activated at a temperature lower than the softening temperature of said polymeric sheet.

11. The thermal imaging laminar medium of claim 10 wherein said polymeric sheet comprises polyethylene terephthalate and said surface layer of heat-activatable polymeric material thereon comprises poly(styrene-co-acrylonitrile).

12. The thermal imaging laminar medium of claim 1, wherein said colorant of said image-forming layer comprises a pigment.

13. The thermal imaging laminar medium of claim 12 wherein said pigment comprises carbon black particles.

14. The thermal imaging laminar medium of claim 13 wherein said binder comprises polyvinylalcohol.

15. The thermal imaging laminar medium of claim 12 wherein the weight ratio of said pigment to said binder is in the range of from 40:1 to 1:2.

16. The thermal imaging laminar medium of claim 15 wherein said ratio is in the range of from about 4:1 to about 10:1.

17. The thermal imaging laminar medium of claim 1, wherein said second sheet covering said image-forming layer is adhesively laminated to said image-forming layer through a release layer, said release layer being adapted to facilitate separation between said first and second sheets and provision of said first and second images.

18. The thermal imaging laminar medium of claim 1 wherein each of said first and second sheets comprises polyethylene terephthalate.

* * * * *